United States Patent [19]

Ishida et al.

[11] Patent Number: 4,939,974

[45] Date of Patent: Jul. 10, 1990

[54] AUTOMATIC ACCOMPANIMENT APPARATUS

[75] Inventors: Takashi Ishida; Yasunao Abe, both of Hamamatsu, Japan

[73] Assignee: Yamaha Corporation, Hamamatsu, Japan

[21] Appl. No.: 291,110

[22] Filed: Dec. 28, 1988

[30] Foreign Application Priority Data

| | | | |
|---|---|---|---|
| Dec. 29, 1987 | [JP] | Japan | 62-333218 |
| Dec. 29, 1987 | [JP] | Japan | 62-333219 |
| Dec. 29, 1987 | [JP] | Japan | 62-333220 |

[51] Int. Cl.[5] ..... G10H 7/00; G10H 1/36; G10H 1/38; G10H 1/40

[52] U.S. Cl. ..... 84/609; 84/601; 84/602; 84/611; 84/613; 84/634; 84/635; 84/637

[58] Field of Search ..... 84/DIG. 12, 1.03, 1.19, 84/1.27, 1.28, 601, 602, 609–613, 634–638

[56] References Cited

U.S. PATENT DOCUMENTS

| | | | |
|---|---|---|---|
| 4,160,404 | 7/1979 | Yamada et al. | 84/625 |
| 4,499,807 | 2/1985 | Ishida | 84/1.03 |
| 4,656,911 | 4/1987 | Sakurai | 84/DIG. 12 |
| 4,674,383 | 6/1987 | Suzuki | 84/611 |
| 4,682,526 | 7/1987 | Hall et al. | 84/613 |
| 4,685,370 | 8/1987 | Okuda et al. | 84/DIG. 12 |
| 4,704,933 | 11/1987 | Kurakake | 84/DIG. 12 |
| 4,708,046 | 11/1987 | Kozuki | 84/DIG. 12 |

FOREIGN PATENT DOCUMENTS

| | | |
|---|---|---|
| 57-93995 | 6/1982 | Japan . |
| 59-140495 | 8/1984 | Japan . |
| 60-23355 | 6/1985 | Japan . |

*Primary Examiner*—A. T. Grimley
*Assistant Examiner*—Matthew S. Smith
*Attorney, Agent, or Firm*—Spensley Horn Jubas & Lubitz

[57] ABSTRACT

An automatic accompaniment apparatus performs an automatic accompaniment having much variety with less storing amount of information (e.g., rhythm pattern data or pattern data). Based on the stored information, generation of tone or chord is controlled. In addition, tie expression or shifting operation is also controlled. In the shifting operation, some of constituent tones constituting the chord are sequentially generated in a shifting manner. The tie expression is applied to the constituent tones which are commonly used between preceding chord and present chord.

5 Claims, 10 Drawing Sheets

| KEY | ... $C_1$ $C_1^{\#}$ ... $B_1$ $C_2$ ... $E_2$ ... $C_3$ ... $F_3^{\#}$ ... $C_4$ ... $C_5$ ... $C_6$ ... |
|---|---|
| KEY CODE | ... 36 37 ... 47 48 ... 55 ... 60 ... 66 ... 72 ... 84 ... 96 ... |

| | MSB 8BITS LSB | |
|---|---|---|
| [-2] | TABLE SELECT | |
| [-1] | DELAY TIME | |
| [0] | $PD_1$ | $PD_0$ |
| [1] | $PD_3$ | $PD_2$ |
| [2] | $PD_5$ | $PD_4$ |
| | | |
| [23] | $PD_{47}$ | $PD_{46}$ |

(RPD)

FIG. 3

| | TBL NO / KEY-ON | 0 | 1 | 2 | 3 |
|---|---|---|---|---|---|
| 0 | NORMAL | 1 | 2 | 3 | 4 |
| 1 | TIE KEY-ON | 5 | 6 | 7 | 8 |
| 2 | DELAY KEY-ON | 9 | A | B | C |
| | OTHERS | D | E | F | 0 |

FIG. 5

FIG. 4

TBLSEL=0 (#0)

| TYPE | TEBNO / TYPE \ ch | 0 | | | 1 | | | 2 | | |
|---|---|---|---|---|---|---|---|---|---|---|
| | | $ch_0$ | $ch_1$ | $ch_2$ | $ch_0$ | $ch_1$ | $ch_2$ | $ch_0$ | $ch_1$ | $ch_2$ |
| M | 1 | 4 | 7 | 12 | 4 | 7 | 14 | 3 | 6 | 11 |
| m | 2 | 3 | 7 | 12 | 3 | 7 | 14 | 2 | 6 | 11 |
| 7th | 3 | 4 | 7 | 10 | 4 | 10 | 14 | 3 | 6 | 9 |
| m7 | 4 | 3 | 7 | 10 | 3 | 10 | 14 | 2 | 6 | 9 |
| M7 | 5 | 4 | 7 | 11 | 4 | 11 | 14 | 3 | 6 | 10 |
| mM7 | 6 | 3 | 7 | 11 | 3 | 11 | 14 | 2 | 6 | 10 |
| $m7^{-5}$ | 7 | 3 | 6 | 10 | 3 | 6 | 10 | 2 | 5 | 9 |
| 7sus4 | 8 | 5 | 7 | 10 | 5 | 10 | 14 | 4 | 6 | 9 |
| Aug | 9 | 4 | 8 | 12 | 4 | 8 | 14 | 3 | 7 | 11 |
| dim7 | 10 | 3 | 6 | 9 | 6 | 9 | 14 | 2 | 5 | 8 |
| 6th | 11 | 4 | 9 | 12 | 4 | 9 | 14 | 3 | 8 | 11 |
| m6 | 12 | 3 | 9 | 12 | 3 | 9 | 14 | 2 | 8 | 11 |
| $7^{-5}$ | 13 | 4 | 6 | 10 | 6 | 10 | 14 | 3 | 5 | 9 |

TBLSEL=1 (#1)

| | | | | | | | |
|---|---|---|---|---|---|---|---|
| M | 1 | 0 | 4 | 7 | 255 | 3 | 6 |
| m | 2 | 0 | 3 | 7 | 255 | 2 | 6 |
| 7th | 3 | 0 | 4 | 10 | 255 | 3 | 9 |
| m7th | | | | | | | |

( MAIN ROUTINE )

PNT →

| | | | | | | | | | | | | |
|---|---|---|---|---|---|---|---|---|---|---|---|---|
| 1ST SECTION | 0 | 1 | 2 | 3 | 4 | 5 | 6 | 7 | 8 | 9 | 10 | 11 |
| | I | F | F | F | F | F | F | F | F | F | F | O |
| 2ND SECTION | 12 | 13 | 14 | 15 | 16 | 17 | 18 | 19 | 20 | 21 | 22 | 23 |
| | I | F | F | F | F | F | F | F | F | F | F | O |
| 3RD SECTION | 24 | 25 | 26 | 27 | 28 | 29 | 30 | 31 | 32 | 33 | 34 | 35 |
| | F | F | F | F | F | F | F | F | F | F | F | F |
| 4TH SECTION | 36 | 37 | 38 | 39 | 40 | 41 | 42 | 43 | 44 | 45 | 46 | 47 |
| | I | F | F | F | F | F | F | F | F | F | F | F |

| | | | | | | | | | | | | | |
|---|---|---|---|---|---|---|---|---|---|---|---|---|---|
| 1ST SECTION | 9 | F | F | F | F | F | F | F | F | F | F | 0 | PD |
| | 0 | 1 | 2 | 3 | 4 | 5 | 6 | 7 | 8 | 9 | 10 | 11 | CLK |
| 2ND SECTION | 1 | F | F | F | F | 0 | A | F | F | F | F | F | PD |
| | 12 | 13 | 14 | 15 | 16 | 17 | 18 | 19 | 20 | 21 | 22 | 23 | CLK |
| 3RD SECTION | 5 | F | F | F | F | 0 | F | F | F | F | F | F | PD |
| | 24 | 25 | 26 | 27 | 28 | 29 | 30 | 31 | 32 | 33 | 34 | 35 | CLK |
| 4TH SECTION | 3 | F | F | F | F | 0 | 1 | F | F | F | F | 0 | PD |
| | 36 | 37 | 38 | 39 | 40 | 41 | 42 | 43 | 44 | 45 | 46 | 47 | CLK |
FIG.18
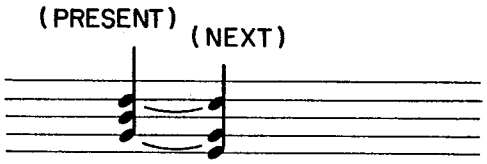
FIG.17
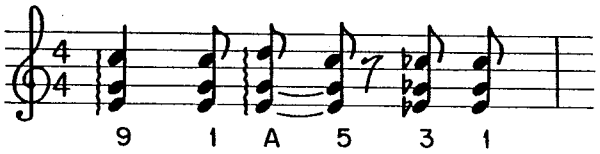
FIG.19

AUTOMATIC ACCOMPANIMENT APPARATUS

BACKGROUND OF THE INVENTION

1. Field of the Invention

The present invention relates to an automatic accompaniment apparatus, and more particularly to an automatic accompaniment apparatus capable of performing an automatic accompaniment having much variety with less storing amount of information.

2. Prior Art

An automatic accompaniment apparatus has been developed which detects a root tone and a chord from key depression data of an accompaniment keyboard and performs an automatic accompaniment based on the detected result and selected rhythm pattern.

The conventional automatic accompaniment apparatus includes an apparatus which only generates rhythms at the same tone pitch in correspondence to a rhythm pattern; an apparatus which plays a variety of bass tones based on tone pitch data stored in advance together with the performance of chords (Japanese Patent Laid Open Publication No. 59-140495); an apparatus which effects an automatic accompaniment of chords corresponding to key depression data of a keyboard (Japanese Patent Publication No. 60-23355 etc.); and an apparatus capable of resulting in a special effect of a performance (background performance effect) by generating musical tones of an accompanying chord successively by the predetermined timing in a shifting manner (Japanese Utility Model Publication No. 57-93995 and the like).

However, the above conventional apparatus has the following drawbacks. The apparatus which generates only rhythms at the same tone pitch lacks musical variety, and the apparatus storing tone pitch data must store large amount of patterns. In particular, the latter preferably changes not only bass tones but respective tones composing a chord to effect an automatic performance full of musical variety, which, however, given rise to the problem that an amount of tone pitch data which must be stored is increased.

Incidentally, when chords are actually played by a human player, a change in a part of tones composing a chord is effected in such a manner that only a finger corresponding to a tone to be changed is moved and keys for common tones remain depressed in many cases. More specifically, the common tones composing the chord are often played by a tie expression.

However, in the conventional automatic accompaniment apparatus, all the tones are repeatedly generated, and then the more natural effect of a performance is difficult to achieve.

In addition, since the conventional automatic accompaniment apparatus for generating tones composing a chord in the shifting manner cannot control a shift interval, it lacks variety of performance effect.

The conventional automatic accompaniment apparatus has also a drawback that delayed tones composing a chord are generated after a chord at the next timing and the performance becomes musically unnatural.

SUMMARY OF THE INVENTION

It is an object of the present invention to provide an automatic accompaniment apparatus capable of generating accompanying chords full of variety with a lesser amount of stored data.

It is another object of the present invention to provide an automatic accompaniment apparatus capable of expressing a tie when common tones are included in a chord when the chord is changed.

It is still another object of the present invention to provide an automatic accompaniment apparatus capable of controlling a shift interval to thereby improve the variety of a performance effect.

It is a further object of the present invention to provide an automatic accompaniment apparatus capable of preventing delayed tones composing a chord from being generated after a chord at the next timing.

In a first aspect of the invention, there is provided an automatic accompaniment apparatus comprising clock generating means for generating a clock signal, memory means for storing rhythm pattern data designating the presence or absence of tone generation and a musical interval of a chord to be generated at each performance timing based on the clock signal, chord designating means for designating the chord to be performed, tone data generating means for reading out the rhythm pattern data based on the clock signal, the tone data generating means generating tone data representative of tones which constitute the chord to be generated based on the musical interval designated by read rhythm pattern data and the chord designated by the chord designating means, and musical tone generating means for generating the chord based on the tone data.

In operation, the tone data generating means designates the presence or absence of tone generation of a chord by the pattern data and designates a musical interval mode of each tone composing the chord. With this arrangement, the tone data generating means creates tone data of each tone composing the chord in accordance with the interval mode designated by the pattern data.

Therefore, musical interval modes stored as the pattern data are not necessary to directly designate the tone pitches of the respective tones, and so an amount of pattern data is greatly reduced.

In a second aspect of the invention, there is provided an automatic accompaniment apparatus comprising chord designating means for designating a chord to be performed, memory means for storing pattern data which control generation of a chord and a tie expression at each performance timing based on a clock signal, musical tone generating means for generating constituent, tones constituting the chord based on the pattern data and the chord which is designated by the chord designating means, wherein the pattern data are sequentially read from the memory means based on the clock signal, and the chord designated by the chord designating means, and tone generation control means for detecting tone pitches of the constituent tones of a chord to be newly generated within the constituent tones of chord which are presently generated when read pattern data designate the tie expression of chord, whereby the tone generation control means controls tone generation such that constituent tones having detected tone pitches are continuously generated.

In operation, when a tone having the same tone pitch as that of tones composing a chord to be generated newly is detected from the tones composing a chord being generated at present at a change of the chord in the case that the pattern data designates the generation of a tie expression, the tone is generated continuously without starting to generate a new tone and the tone is generated in the tie expression.

In a third aspect of the invention, there is provided an automatic accompaniment apparatus comprising chord designating means for designating a chord to be played, pattern storing means for storing pattern data designating generation of a chord based on a clock signal, said pattern data also designating whether each of constituent tones constituting the chord is to be generated in a shifting manner or not, a time storing means for storing a shifting time which is used when each constituent tone of a chord must be generated in the shifting manner, the time storing means being provided in correspondence with the pattern data, musical tone generating means for generating each constituent tone of a chord based on the pattern data and the chord designated by the chord designating means, wherein the pattern data are sequentially read from the pattern storing means based on the clock signal, and shifting means for shifting generation timings of the constituent tones of the chord in accordance with the shifting time in the musical tone generating means when the pattern data designate that the constituent tones of the chord must be generated in the shifting manner.

Further, there is also provided another automatic accompaniment apparatus comprising, in addition to the above arrangements, releasing means for releasing shifting control of the shifting means before an initially designated performance timing when the pattern data designate generation of a chord after the initially designated performance timing, whereby the constituent tones which have not been generated yet are forced to be generated.

In operation, since shift times used to shift a timing at which tones composing a chord are generated are stored in the time storing means in correspondence to pattern data and the shifting means is operated in accordance with the data in the time storing means, the shift time of the tones composing the chord is controlled.

Further, when the automatic accompaniment apparatus is provided with the releasing means, delayed tones composing a chord are prevented from being generated after the tone generation timing of a subsequent chord due to the shifted tone generation.

BRIEF DESCRIPTION OF THE DRAWINGS

FIG. 3 is a diagram showing a format of rhythm pattern data in the embodiment;

FIG. 4 is a diagram showing the contents of tables for determining musical intervals of chords to be automatically accompanied;

FIG. 5 is a diagram showing a function of tone generation mode indicating data;

FIG. 17 is a score explanatory of a tie key-on process;

FIG. 18 is a diagram showing an example of tone generating mode indicating data in an example of a total operation; and FIG. 19 is a score showing an example of a musical performance when the tone generating mode indicating data shown in FIG. 18 is used.

DESCRIPTION OF THE PREFERRED EMBODIMENT

An embodiment of the present invention will be described in detail with reference to the drawings.

(1: Arrangement of the Embodiment)

Figures 1, 2:
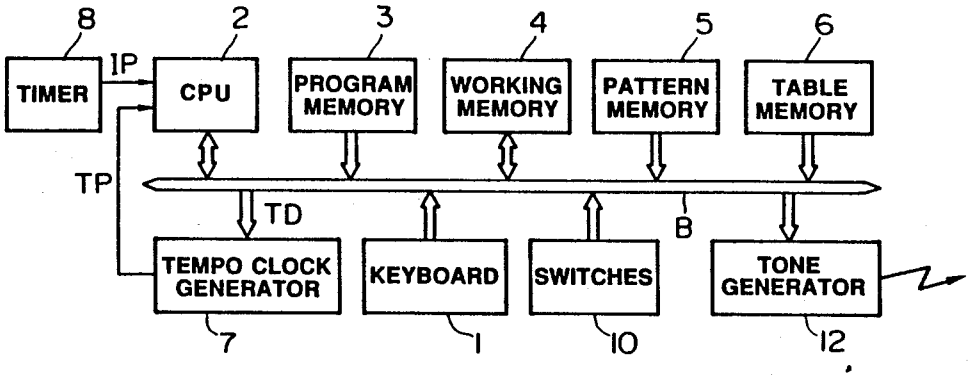
FIG. 1 is a block diagram showing an embodiment of the present invention.
FIG. 2 is a diagram showing a relationship between keys and key chords.

FIG. 1 is a block diagram showing an embodiment of the present invention.

In FIG. 1, numeral 1 designates a keyboard unit comprising a plurality of keys, a plurality of key switches for detecting an ON/OFF state of each key and an interface circuit for supplying a key code of each key switch to a bus line B. FIG. 2 shows a corresponding relation between the keys and the key codes. FIG. 2 shows the key chord by a decimal notation and it is understood from the drawing that the value of a key code is changed by "1" for each half tone and a tone $C_3$ corresponds to a key code "60".

Numeral 2 designates a CPU (central processing unit) controlling respective units of an apparatus, numeral 3 designates a program memory storing a program of the CPU 2 and numeral 4 designates a working memory 4 wherein various registers and flags are set. The registers and the flags in the working memory will be described later.

Next, numeral 5 designates a pattern memory storing pattern data RPD used when accompanying tones of rhythm tones and chords are generated. The pattern memory 5 stores pattern data RPD corresponding to rhythm kinds (samba, slow rock and the like) and chord types in advance. FIG. 3 shows a format of the pattern data RPD. As shown in the drawing, the pattern data is composed of data of 26 bytes and relative addresses "−2", "−1", "0", "1", . . . "22", "23" are set to the respective bytes. The data of each address will be described below.

Address "—2": This address stores table select data TBLSEL of 8 bits for designating any one of tables #0, #1 . . . shown in FIG. 4. The tables #0, #1 . . . are stored in a table memory 6.

Address "−1": This address stores delay time data indicating a shift time used when tones forming a chord, which should be originally generated simultaneously in the accompaniment of the chord, are shifted a little. The data is used to reproduce such a case as a stroke play of a guitar wherein respective guts are played almost simultaneously but actually each gut is played with a fine shift of timing in generating tone (e.g. a sixth gut is played first and a first gut is played last and vice versa).

Address "0"-"23": These addresses store No. 0 tone generating mode indicating data PD through No. 47 tone generating mode indicating data PD indicating musical interval modes and key-on modes of chords. The reason why the forty eight kinds of the tone generating mode indicating data $PD_0$–$PD_{47}$ are stored is that the embodiment has a bar (4 beats) divided into 48 timings and tone generation is controlled at each divided timing. The tone generating mode indicating data PD is 4 bits of data represented by a hexadecimal notation $(0)_H$–$(F)_H$ and sequentially used as a unit of 4 bits in accordance with each tone generation timing. FIG. 5 shows a relationship between the content of the tone generating mode indicating data and tone generating modes indicated.

"Normal" in FIG. 5 is a usual key-on mode generating tones at the divided timing and "tie key-on" is a mode wherein when any one of the notes for generating tones (constituent tones of a chord) is connected to a previous note (constituent tones of a chord) by a tie symbol (refer to FIG. 17), the tone corresponding to the note is not newly generated again and the previous tone is continuously extended. "Delay key-on" is a mode of a performance using the above delay time data. Numerical values in an upper horizontal column in the drawing are musical interval mode numbers TEBNO and indicate any one of the musical interval modes set in each table in FIG. 4. In the table #0, TEBNO "0" indicates a musical interval relation of the usual constituent tones of a chord determined by a chord type, TEBNO "1" indicates a musical interval relation of constituent tones of a chord including a 9th (ninth) tone, and TEBNO "2" indicates a musical interval relation wherein each of the usual tones composing the chord is lowered by a half tone. In the table #1, a musical interval mode number TEBNO "0" indicates a musical interval relation of the usual tones composing a chord and "1" indicates a musical interval relation wherein each of the usual tones composing the chord is lowered by a half tone. As described above, the value of the interval mode number TEBNO has its function arbitrarily set depending on a table number selected.

The symbols of the chord types shown in FIG. 4 use general purpose chord type symbols, and, for example, M represents major, m represents minor, sus represents suspend, Aug represents augment, dim represents diminish and numerals represent seventh, sixth and the like. These chord types are designated by hexadecimal chords of 1–D. Designated at ch is a tone generation channel and in the embodiment an automatic accompaniment using a plurality of tones is performed through three channels $ch_0$–$ch_2$. The numerical values "0"–"255" (indicated by decimal notation) shown in a column of the respective tone generation channels ch in FIG. 4 represent key codes.

When the content of the tone generating mode indicating data PD is represented by $(1)_H$–$(C)_H$, it indicates the interval number TEBNO as described above, when the content is represented by $(0)_H$, it indicates key-off, and when it is represented by $(F)_H$, it indicates to maintain the previous state without doing anything. The content of the tone generating mode indicating data PD represented by $(D)_H$, $(E)_H$ is not used in the embodiment (refer to FIG. 5).

The functions of the respective data in the pattern are described above and a plurality of pattern data in accordance with the format shown in FIG. 3 are stored in correspondence to the kinds of rhythms and chord type. The addresses "−2" and "−1" serve as headers of the pattern data.

Numeral 7 in FIG. 1 designates a tempo clock generator for outputting a tempo clock TP serving as a base of tempo to automatically played tone to the CPU 2 at a prescribed cycle. The tempo clock TP causes the CPU 2 to be interrupted, wherein the cycle of the tempo clock TP is determined in accordance with tempo data TD supplied from the CPU 2 through the bus line B.

Numeral 8 designates a timer for applying a pulse signal to the CPU 2 as an interruption signal at a prescribed cycle. The timer 8 is used to measure a delay time set in a performance using delay time data (refer to FIG. 3).

Numeral 10 designates a group of switches including a rhythm selection switch, a rhythm start/stop switch, a tone color selection switch, various kinds of effect selection switches and the like. Numeral 12 designates a tone generator for generating musical tones corresponding to the keyboard played by a player based on key-on/key-off data produced by the CPU 2 in accordance with key depression/key release of the keyboard circuit 1 and also generating accompaniment chords based on the pattern data RPD. The tone generator 12 also includes a percussion rhythm tone source and generates rhythm tones corresponding to a selected rhythm in accordance with the tempo clock TP.

Leading ones of the various registers and flags in the above memory 4 will be described.

Flag RUN: "1" is written in it during the automatic accompaniment and "0" is written when it stops. Register CLK: The count number of the tempo clock TP is written in the register and values "0" to "47" are written periodically for each bar.

Registers DL1, DL2: The registers measure the delay times of channels $ch_1$ and $ch_2$ and the delay time data shown in FIG. 3 is written in them. The delay time data is subtracted each time a clock is outputted from the timer 8 and when the content of the registers DL1, DL2 becomes 0, a corresponding channel is permitted to generate tones.

Key code buffer KCBUF: This is a register in which a key code of a depressed key is written. A plurality of the buffers are provided.

Register CHD: This is a register in which chord data is written. When the CPU 2 detects a chord type and root tone from a key code of the accompanying keyboard, chord type data is written in the upper four bits and root tone data is written in the lower four bits, respectively. The root tone data is represented by "0", "1", . . . "11" which correspond to a tone C, a tone C#, . . . a tone B. The chord type data corresponds to the chord types shown in FIG. 4 and is represented by "1"–"13" corresponding to major M, minor m, seventh 7th and the like.

Register TCHD: This is a register in which the above chord data is stored temporarily.

Register ROOT: This is a register in which the above root tone data is stored temporarily.

Register TYPE: This is a register in which the chord type data is stored.

Register CHK: This is a register in which calculated values of CKL.MOD.12 are stored and the CKL.MOD.12 is the surplus of the quotient obtained by dividing the content of the register CLK by 12. The CKL.MOD.12 represents a timing in a first section.

Register: TBLSEL.R: This is a register in which the table select data (refer to FIG. 3) is written.

Register DLYTM: This is a register in which the delay time data (refer to FIG. 3) is written.

Address pointer PNT: This is a pointer showing addresses of the pattern format shown in FIG. 3.

Registers DT and NDT: They are registers in which the tone generating mode indicating data PD is written, respectively, and a tone generating mode indicating data $PD_n$ at the timing is written in the register DT and a tone generating mode indicating data $PD_{n+1}$ at the next timing is written in the register NDT.

Registers $KEY_{0-2}$: They are key code buffers provided in accordance with the tone generation channels $ch_0$–$ch_2$ in the tone generator 12. Tone pitches of tones generated by the tone generation channels $ch_0$–$ch_2$ are determined by the key codes written in the registers $KEY_0$–$KEY_2$.

Registers $OKEY_{0-2}$: They store the previous values in the registers $KEY_{0-2}$.

Flag MODE: When the flag is "0", it indicates a usual key-on mode for turning on a key by writing a new chord in a channel chi ($i=1\sim2$). When the flag is "1", it indicates a tone generation process (to be described later in detail) to replace key codes only to tone generation channels which are already in a tone generation state.

Register RTKEY: This is a register in which a key code having a converted compass of root data in the register ROOT is written.

The aforesaid are the leading registers, flags and the like provided in the working memory 4.

(2: Operation of the Embodiment)

Next, the operation of the embodiment arranged as above will be described.

Basically, the operation of the embodiment is an automatic accompaniment generating a chord (3 tones) in accordance with rhythm. With the present embodiment, since there are different tone generation processes depending on key-on modes, the embodiment will be described below for the respective key-on modes.

A: Normal (1) Main routine "MAIN"

Figure 6:
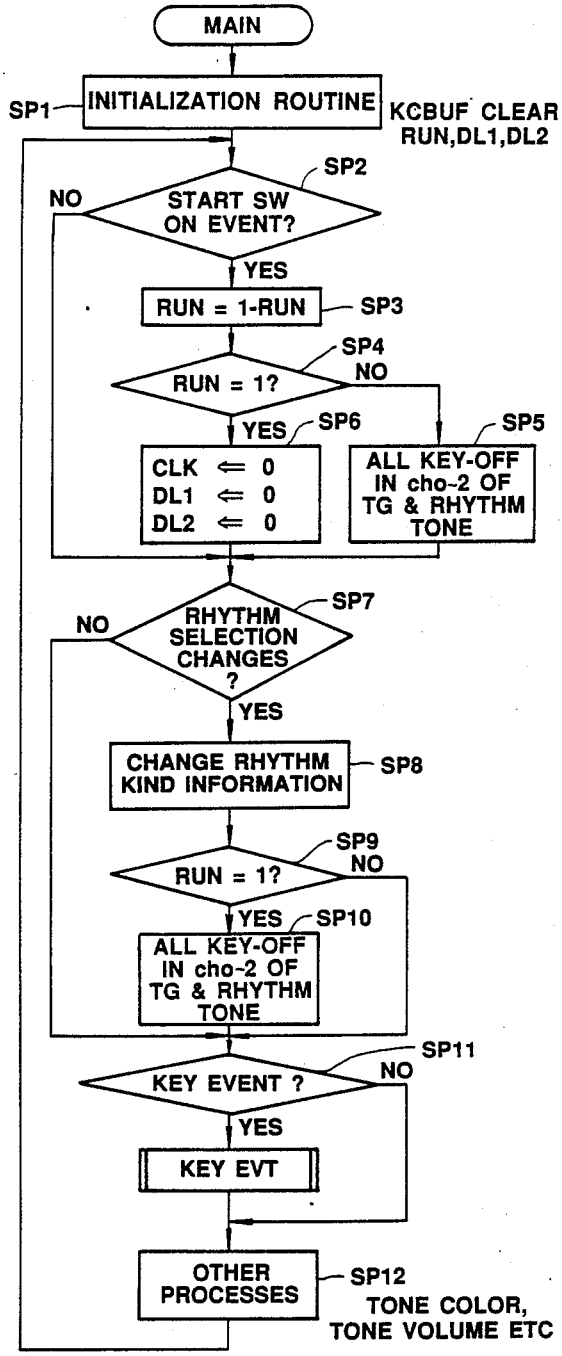
FIG. 6 is a flowchart showing a main routine of the embodiment.
Figure 7:
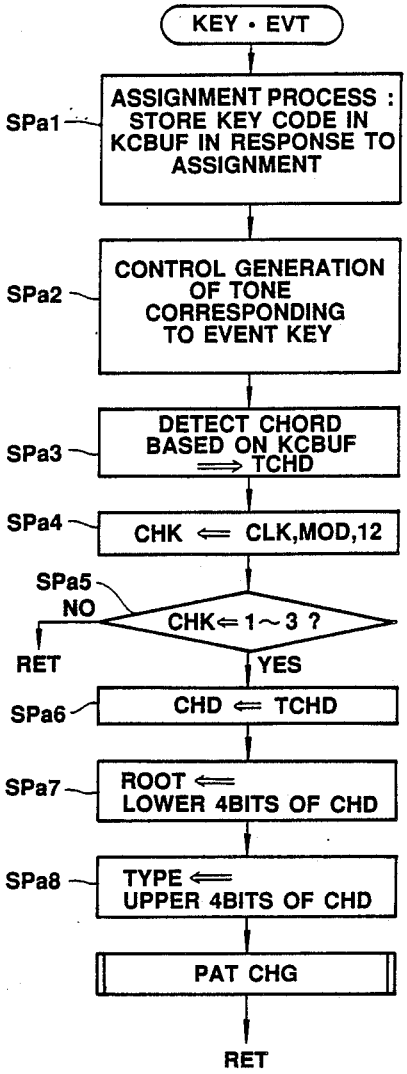
FIG. 7, FIG. 8, FIG. 11, FIG. 12, FIG. 13, FIG. 14 are flowcharts showing subroutines of the embodiment, respectively.

FIG. 6 is a flowchart showing a main routine of the embodiment. First, when power is applied, the various kinds of the registers and flags (KCBUF, RUN, DL1, DL2 and the like) in the working memory 4 are cleared as an initializing process, then a program goes to a step SP2 and steps following the step SP2.

If an on-event occurs in a start switch in the group of the switches 10 is checked in the step SP2. Note, the event means that the state of the switches and the flags is changed and it includes the on-event wherein a change from an off-state to an on-state occurs and an off-event wherein a change from the on-state to the off-state occurs. When the on-event of the start switch is detected in the step SP2, the value of the flag RUN is inverted in a step SP3. The processes in the steps SP2, SP3 cause the value of the flag RUN to be inverted each time the start switch is depressed. Next, if the flag RUN is "1" is checked in step SP4. If the check result is "NO", it is an indication to interrupt an automatic accompaniment. Then, a program goes to a step SP5 to turn off the channels $ch_0$–$ch_2$ of the tone generator 12 and to turn off the generation of all rhythm tones (percussion etc). When the the flag RUN is decided to be "YES" in the step SP4, it is the case wherein a start of the automatic accompaniment is indicated so that the program goes to a step SP6 to clear the registers CLK, DL1, DL2 for the preparation of the start of the automatic accompaniment. After the processes in the steps SP5, SP6 are completed, the program goes to a step SP7 to check if the selection of a rhythm is changed. On the other hand, when the check result in the step SP2 is "NO", that is, when the start switch remains on or off, the processes in the step SP3 through the step SP5 are not executed and the program goes to a step SP7. When the check result in the step SP7 is "YES", data indicating the kind of rhythm is changed to indicate the changed rhythm (step SP8), and if the flag RUN is "1" is checked in a step SP9. If the check result is "YES", it is the case wherein the kind of the rhythm is changed during the automatic accompaniment so that tone generation by the accompaniment using the previously selected of rhythm is stopped and an accompaniment is prepared to use a newly selected rhythm in a step SP10, then if there is a key event is checked in a step SP11. On the other hand, if the check result in the step SP9 is "NO", it is the case wherein an automatic accompaniment has not been continuously effected or the flag RUN is cleared in the step SP3 to stop an automatic accompaniment. Thus, since the tone generation by the channels $ch_0$–$ch_2$ in the tone generator 12 is already stopped, the process in the step SP10 is not executed and a check is effected immediately in a step SP11. The check in the step SP11 is executed by the CPU 2 which checks a change in a key code supplied from the keyboard circuit 1. If there is no key event, the program goes to a step SP12 to set or change tone color and tone volume in accordance with the operation of other switches in the group of the switches 10 and returns to the step SP2 again to repeat the above processes.

If there is a key event, the program goes to processes in a subroutine "KEY, EVENT".

(2) Subroutine "KEY EVT"

Figure 12:
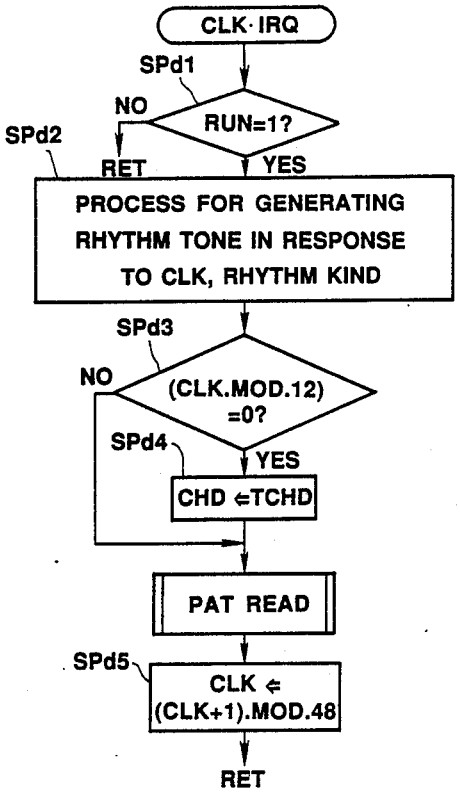
Figure 14:
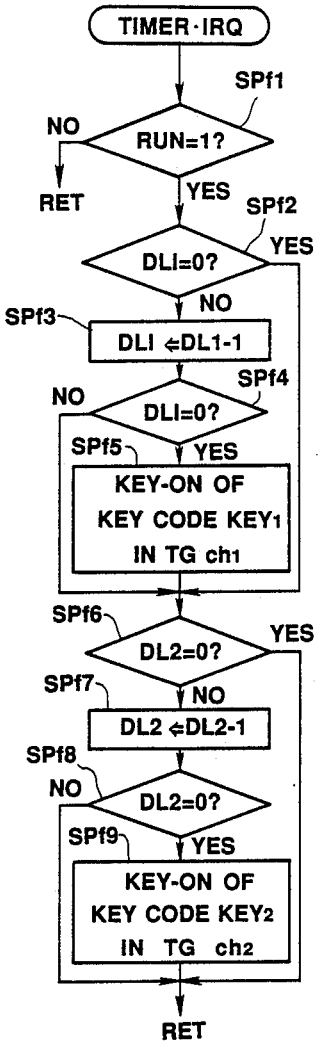

First, a key code generated in the keyboard circuit 1 is written in the key code buffer KCBUF in a step SPa1. If a plurality of key codes are generated, they are assigned to the respective key code buffers KCBUF according to a predetermined allocation process of a key for which an event occurs. Then, a program goes to a step SPa2 to effect a tone generation process. The tone generation process is effected by a tone generation channel other than the channels $ch_0$–$ch_2$ of the tone generator 12. More specifically, the tone generation is a direct tone generation process in accordance with key depression which is other than playing of chords such as playing of melodies. Next, a chord tie and a root tone are detected based on the key code in the key code buffer KCBUF and they are written in the register TCHD in a step SP3. A calculation of CLK.MOD.12, i.e., a calculation to determine a surplus by dividing the content of the register CLK by 12 is effected in a step SPa4 and the result of the calculation is written in the register CHK. As described above, the result of the calculation shows a timing in a first section. Although the content of the register CLK is reset to "0" at the start of the automatic accompaniment, it is incremented by 1 by the process of a subroutine CLK.ERQ (refer to FIG. 12) each time a tempo clock TP is generated by the tempo clock generator and it becomes a value to indicate a timing ("0"–"47") in a bar. When the process in the step SPa4 is completed, the program goes to a step SPa5 to check if the content of the register CHK is 1–3. This is effected to check a timing at which a key event occurs is within one fourth from the start of a first section. If the check result is "YES", the data in the register TCHD is written in the register CHD in a step SPa6. The data written in the register TCHD (root tone data+chord type data) is used for the following tone generation processes. On the other hand, if the check result in the step SPa5 is "NO", the program returns to the main routine "MAIN" and the content of the register TCHD is written in the register CHD at the front timing of the next section (refer to step SPd4 of FIG.

12). More specifically, when a key event occurs at the front portion of a first section, the root tone data and the chord type data of changed chords are written in the register CHD to be used for the tone generation process of an automatic accompaniment, but when the key event occurs at a portion other than the front portion of the section, the front timing of the next section is waited before the root tone data and the chord type data of the changed chords are written in the register CHD. This is effected to avoid a musically unnatural change in the chords generated by the automatic accompaniment which would be otherwise caused in the middle of the section.

When the process in the step SPa6 is completed, the root tone data and the chord type data in the register CHD are written in the register ROOT and the register TYPE, respectively (refer to steps SPa7, SPa8) and the program goes to processes in a "subroutine PAT.CHG".

(3) "Subroutine PAT.CHG"

When a key event occurs, the processes are effected to harmonize the previously effected automatic accompaniment with the automatic accompaniment effected based on a new key event.

First, a kind of rhythm selected and pattern data RPD to be played next based on the content of the register TYPE are read and written in the register PAT in a step SPb1. Then, the table select data TBLSEL in the address "−2" and the delay time data in the address "−1" of the read pattern data RPD (refer to FIG. 3) are written in the register TBLSEL.R and the register DLYTM, respectively in a step SPb2. Next, the value of the register CLK, i.e., a count value of the clock at the time is written in the pointer PNT (step SPb3) to check if the calculated value of PMT.MOD.2 is "0" (step SPb4). The calculation is effected to check if the clock count value (value of CLK) at the time is even or odd and if the calculated value is "0", the count value is even. When it is even, a program goes to a step SPb5 to write the tone generating mode indicating data PD in the lower four bits in an address "PNT/2" of the pattern data RPD in the register DT. If the value calculated in the step SPb4 is odd, the program goes to a step SPb6 to write the tone generating mod data PD in the lower four bits in an address "(PNT/2)" of the pattern data RPD in the register DT. The above processes in the steps SPb4–SPb6 are effected to cause the clock count value to coincide with the number of the tone generating mode indicating data PD. For example, if the clock count value written in the pointer PNT is "1", tone generating mode indicating data $PD_1$ in the upper four bits of an address "0" is selected, and if the clock count value is "46", tone generating mode indicating data $PD_{46}$ in the lower four bits of an address 23 is selected (refer to FIG. 3). When the tone generating mode indicating data PD corresponding to the clock count value is written in the register DT in the above process, the program goes to a step SPb7 to check if the content of the register is $(F)_H$ or not, that is, to check the content indicates "do nothing". If the check result is "YES", the value of the pointer is decremented by 1 and the processes in the step SPb4 and the steps following it are effected again through a step SPb9. The processes are continued until the content of the register DT becomes any one other than $(F)_H$. Then, when any data other than $(F)_H$ is detected, the program goes to a step SPb11 to check if the content of the register DT is "0", e.g., if the content is data to indicate key-off. If the check result is "YES", the program returns to the main routine "MAIN" (refer to FIG. 6) in the case that the content of the registers $KEY_{0-2}$ is "0". If the content is not "0", the program effects key-off of all the channels $ch_0$–$ch_2$ of the tone generator 12 (steps SPb16, SPb17) and clears the registers $KEY_{0-2}$, then returns to the main routine "MAIN".

Here, the meaning of a series of the processes in the above steps SPb4 to SPb11 and SPb15 to SPb17 will be described.

Figures 9, 10:
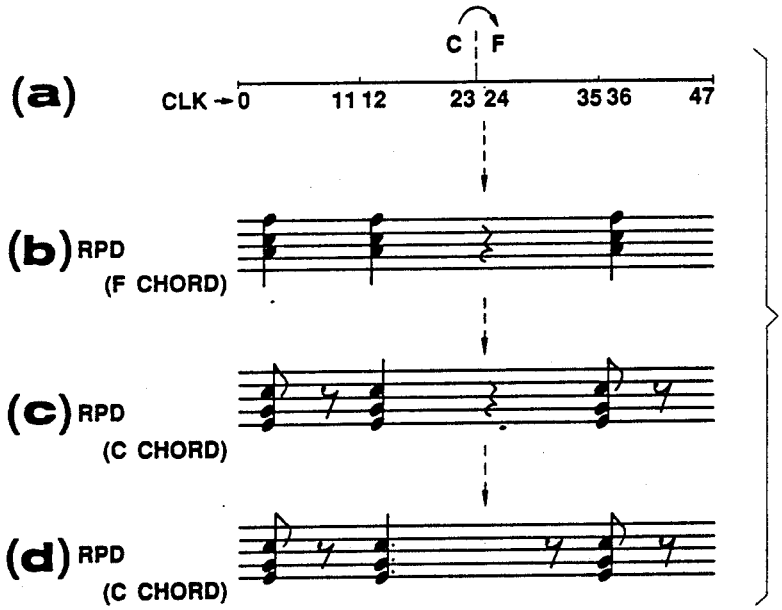
FIG. 9 is a diagram showing a tone generation process when a key event occurs while an automatic accompaniment is being performed.
FIG. 10 is a diagram showing an example of tone generating mode indicating data.

As shown in FIG. 9 (*a*), assume that a chord C major is changed to a chord F major at the front timing of a third section. Assume that pattern data RPD corresponding to the chord F major which is read newly by the change is the one indicated by FIG. 9 (*b*) on a score. The score is shown, for example, in FIG. 10 as tone generating mode indicating data. Since the value of the register CLK at the front timing of the third section is "24", a value to be written in the pointer PNT in the step SPb3 is "24". Then, if the value of tone generating mode indicating data $PD_{24}$ is $(F)_H$ is checked in the step SPb7 through the steps SPb4→SPb5→SPb7. Since the value is $(F)_H$ in the case, the check result is "YES". Incidentally, since the meaning of $(F)_H$ is "do nothing", when key-on was indicated before it, the tone must be continued and when key-off was indicated before it, a tone damping state must be maintained. Therefore, if the tone generating mode indicating data PD at a timing is $(F)_H$, what kind of tone generation control is to be effected is not clear. Therefore, tone generating mode indicating data at a previous timing which is other than $(F)_H$ is necessary to be searched. The processes in the steps SPb4–SPb10 are effected for the search. Since the tone generating mode indicating data $PD_{24}$ is $(F)_H$ in the above example, tone generating mode indicating data $PD_{23}$ just before it is checked and found to be $(0)_H$ so that it is understood that tone damping must be maintained in the clock count value "24". The decision of the tone damping corresponds to the case of "YES" in the step SPb11.

Assume that pattern data RPD when a chord C major has been accompanied before a key event occurs is the one shown in FIG. 9 (*c*) on a score. Since tone damping is indicated by the clock count value "23" in the case as shown in the drawing, all the contents of the registers $KEY_{0-2}$ at the time are "0" to indicate the tone damping. More specifically, the tone generating mode at the clock count value "24" before the change (FIG. 9 (*c*)) is identical with that after the change (FIG. 9 (*b*)). In such a case, the decision in the step SPb15 becomes "YES" so that the program returns without effecting any tone generation process.

On the other hand, assume that pattern data RPD when a chord C major has been accompanied before the key event occurs is the one shown in FIG. 9 (*d*) on a score. In this case, it is necessary, as shown in the drawing, that a tone generated at a second section is continued at the clock count value "23". Therefore, a key code (key code for a dotted quarternote) corresponding to the tone at the second section is written in the registers $KEY_{0-2}$, respectively. However, tone damping is necessary at the clock count value "24" (a third section) after the chord has been changed. (refer to FIG. 9 (*b*)). Then, the program goes to a step SPb16 in such a case to effect key-off of the tone generation channels $ch_0$–$ch_2$ of the tone generator 12 for tone damping and further the program clears the registers $KEY_{0-2}$ before it returns (step SPb17).

The aforesaid is the meaning of the processes of the steps SPb4–SPb11 and SPb15–SPb17.

The processes of the steps SPb11–SPb17 are a case wherein tone damping is indicated at the timing after the change, whereas there is a case wherein tone generation is indicated. Processes are effected in the case in the steps SPb11–SPb14, which are described as follows.

When the tone generating mode indicating data PD is other than $(F)_H$ and $(0)_H$ at the timing in the pattern data after the change and when the tone generating mode indicating data PD detected by going back successively from the timing is other than $(0)_H$, tone generation is indicated after the change. Since the check result in the step SPb11 is "NO" in such a case, a check in the step SPb12 is effected. The check is the same as that in the above step SPb15, and when the check result is "YES", tone is damped at the timing by the pattern data before the change. When the check result is "NO", tone is generated at the timing by the pattern data before the change. When the check result is "YES" in the step SPb12, "0" is written in the flag MODE, and when it is "NO", "1" is written in the flag MODE (steps SPb13, SPb14). Then, the program goes to processes in a subroutine "PAT.KEY" after the processes are completed. A tone generation process is effected in the subroutine.

(4) Subroutine "PAT.KEY (normal)"

The subroutine is executed to control the tone generation channels $ch_0$–$ch_2$ of the tone generator 12. However, since the key-on mode shown in FIG. 5 has different processes in the cases of "normal", "tie key-on" and "delay key-on", respectively, the case of "normal" will be described here.

Figure 11:
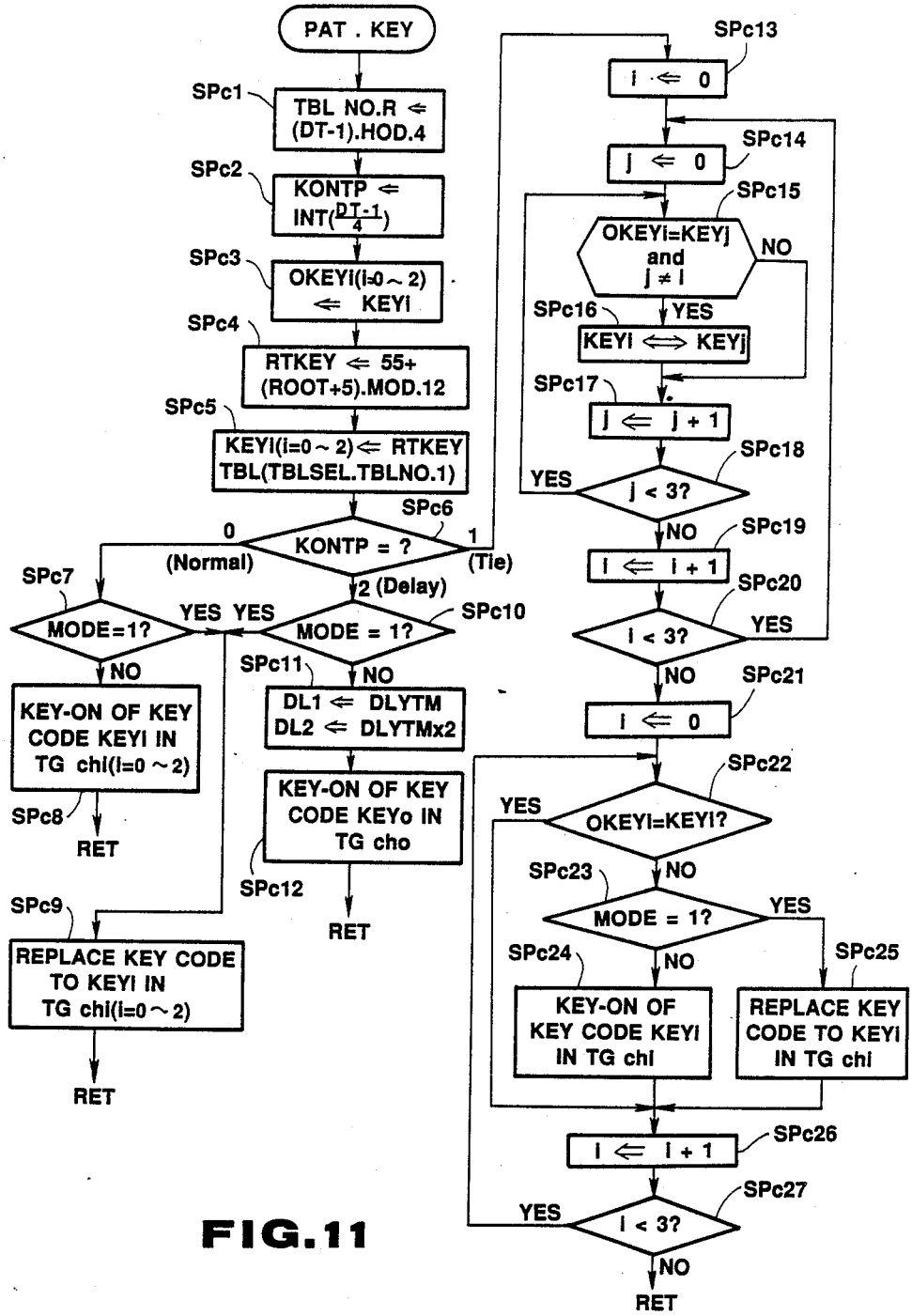

First, a calculation of (DT−1).MOD.4 is effected in a step SPc1 shown in FIG. 11, and the result of the calculation is written in the register TBLNO.R. The calculation is effected to convert the value of the tone generating mode indicating data PD into a musical interval mode number TBLNO (refer to FIG. 5). Next, a calculation for converting the value of the tone generating mode indicating data PD into a key-on mode number, i.e., INT{(DT −1)/4} is effected in a step SPc2 and the result of the calculation is written in the register KONTP. The value of the register KEYi (i=0∼2) is written in the register OKEYi in a step SPc3. The process in the step SPc3 is a process to write the previous key chord generated in the channels $ch_0$–$ch_2$ at the time in the register OKEY of the same number. Next, a program goes to a step SPc4 to effect a process to change the compass of the root tone into $G_3$–$F\#_3$ in accordance with the calculation shown in the drawing and to write the root tone after the change in the register RTKEY. An example of the process will be described. When the root data in the register ROOT is "0" indicating a tone C, the calculation of (ROOT+5)-.MOD.12 results in "5" and the addition of "55" to it results in "60". As shown in FIG. 2, a key chord "60" is a key code of a tone $C_3$.

Next, in step SPc5, the table which coincides with a select number in the register TBLSEL.R (already set in the step SPb2) is read and the data corresponding to a musical interval mode number in the register TBLNO.R is read in the table. Then, the values of the read data corresponding to the channels $ch_0$–$ch_2$ are added to the values of the register RTKEY, respectively and the results of the additions are written in the registers $KEY_{0\text{-}2}$, respectively. If the content of the register RTKEY is a key code "60", the table is #0 and the interval mode number TEBNO is 0 and the chord type is M (major), 4, 7, and 12 are added to 60, respectively, as shown in FIG. 4. Therefore, a key code "64" is written in the register $KEY_0$, a key code "67" is written in the register $KEY_1$ a the key code "72" is written in the register $KEY_2$, respectively. The key codes "64", "67", "72" correspond to a tone $E_3$, a tone $G_3$ and a tone $C_4$, respectively.

When the process in the step SPc5 is completed, the program goes to a step SPc6 to check if the content of the register ONTP is any one of "0", "1", and "2". More specifically, if the key-on mode is "normal", "delay key-on" or "tie key-on" is checked.

Since "normal" is described here, the program goes to a step SPc7. In the step SPc7, if the content of the register MODE is "1" is checked. If the check result is "NO", the key chord written in the registers $KEY_{0\text{-}2}$ in the step SPc5 is supplied to the tone generation channels $ch_0$–$ch_2$ in the tone generator 12 to generate the tone of the key code (step SPc8). On the other hand, if the content of the register MODE is "1", the check result in the step SPc7 becomes "NO" and tone is generated by substituting the key chord written in the registers $KEY_{0\text{-}2}$ for the key code in the tone generation channels $ch_0$–$ch_2$ in the tone generator 12 (step SPc9). The reason why the key chord is substituted is that since the tone generation channels $ch_0$–$ch_2$ continue to generate tone using the key chord supplied previously when the register MODE is "1" (refer to steps SPb12, SPb14), the new chord is substituted for the previous chord to generate ceaseless tone (to generate tone corresponding to a slur symbol).

Figure 8:
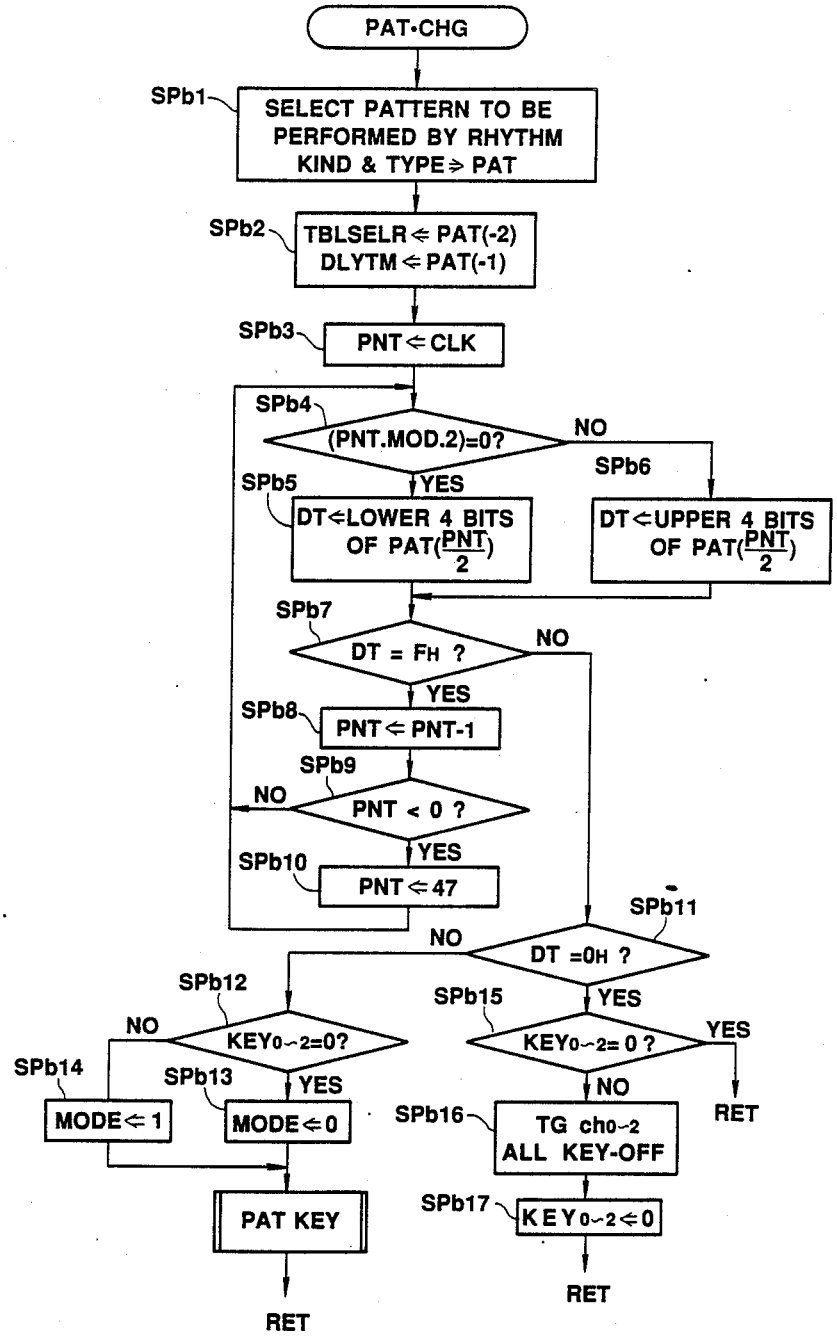

When the key-on processes in the steps SPc8, SPc9 are completed, the program will return. When the subroutine is called in "PAT.CHG" (FIG. 8), the program will return to the main routine.

The above description of the operation refers to a tone generation process when a key event (change in chord) occurs during an automatic accompaniment wherein the program returns to the main routine "MAIN" through the routine composed of "MAIN"→"KEY.EVT→"PAT.CHG"→"PAT KEY". Incidentally, when tone generation is not indicated at the timing of the pattern data after the change, the program will returns to the main routine "MAIN" after effecting a tone damping process (step SPb16) and the like in the subroutine "PAT.CHG".

A usual tone generation process of the automatic accompaniment is a process performed automatically based on the tempo clock TP. The processes in this case is effected based on a subroutine "CLK.IRQ" shown in FIG. 12 and a subroutine "PAT.READ" shown in FIG. 13. These subroutines will be described below.

(5) Subroutine "CLK.IRQ:

First, when a tempo clock TP is generated from the tempo clock generator 7 shown in FIG. 1, the CPU 2 is interrupted. As a result, the processes in the subroutine "CLK.IRQ" are effected. If the flag RUN is "1" is checked in a step SPd1. If the check result is "NO", a program returns and if the check result is "YES", the program goes to a step SPd2. In the step SPd2, a rhythm tone generation process (percussion tone generation) is effected in accordance with the value of the register CLK and the kind of rhythm selected. Next, the program goes to a step SPd3 to check if the surplus obtained by dividing the content of the register CLK by 12 is "0". If the check result is "YES", the content of the register CLK indicates the front timing of a section (0, 12, 24, 36). If the check result in the step SPd3 is "NO", the processes in a subroutine PAT. READ are immediately effected and if the check result is "YES", the content of the register TCHD is written in the register (step SPd4), then the program goes to the above subroutine "PAT.READ". The process in the step SPd4 is effected to write the key chord which was not written in the register CHK because the check result in the above step SPa5 was "NO".

(6) Subroutine "PAT.READ"

Figure 13:
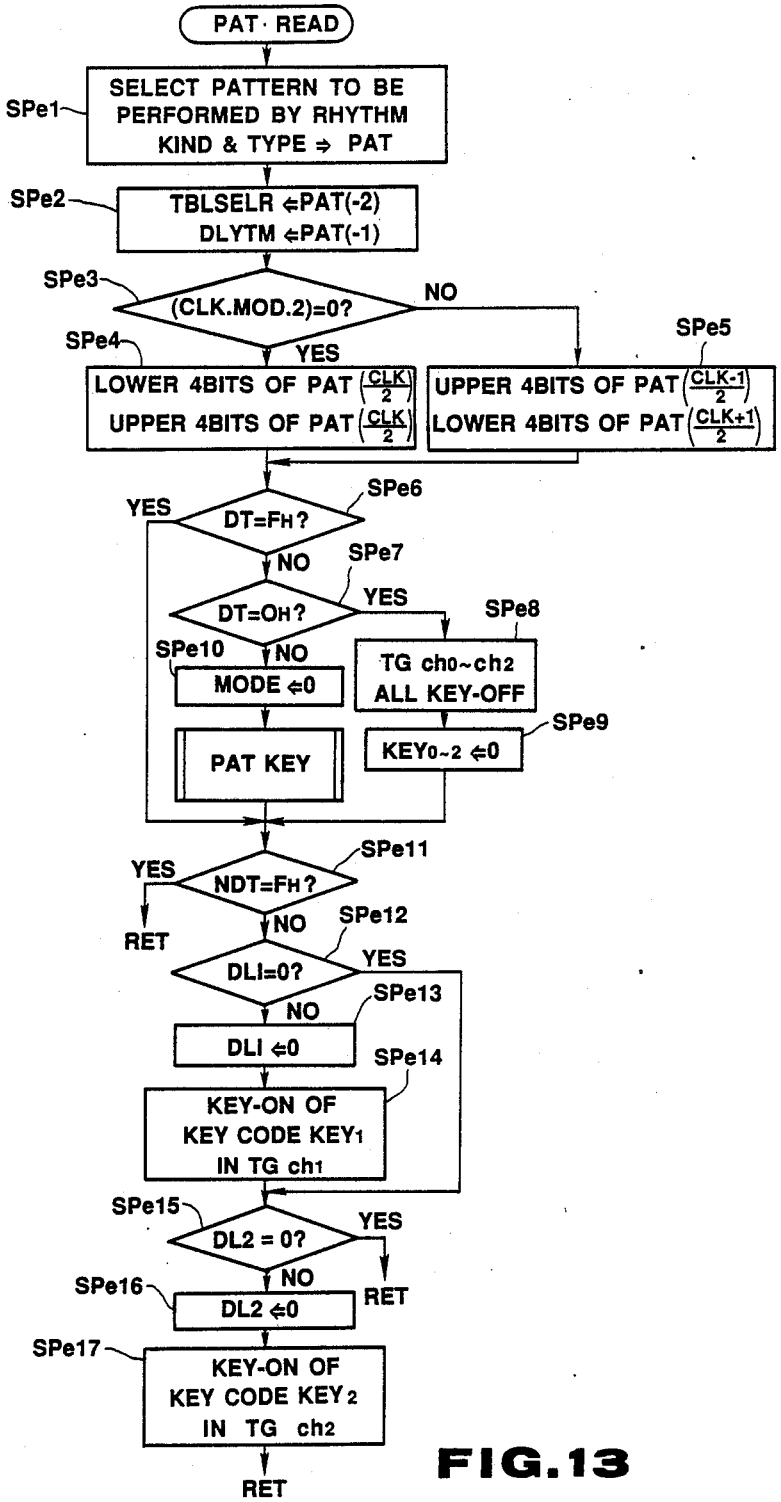

First, in a step SPe1 shown in FIG. 13, pattern data RPD to be performed is selected based on the kind of rhythm and the chord type data in the register TYPE and it is written in a register PAT. Table select data TBLSEL and delay time data in the addresses "−2", "−1" of the pattern data RPD are written in the register TBLSEL and the register DLYTM, respectively. Next, in a step SPe3, if the content of the register CLK is even or odd is checked. If the check result is even, a program goes to a step SPe4 to write the tone generating mode indicating data $PD_n$ and $PD_{n+1}$ (n means the content in the register CLK) at the lower four bits and the upper four bits of an address "CLK/2" of the pattern data in the registers DT and the NDT, respectively. If the content of the register CLK is odd, the tone generating mode indicating data $PD_n$ and $PD_{n+1}$ at the upper four bits of an address "(CLK−1)/2" and the lower four bits of an address "(CLK+1)/2" of the pattern data are written in the registers DT and the NDT, respectively (step SPe5). The processes in the steps SPe4, Spe5 enable a tone generating mode indicating data PD to be processed at the time to be written in the register DT and a tone generating mode indicating data PD to be processed at the next timing (CLK+1) to be written in the register NDT. For example, when the content of the register CLK is "4", the tone generating mode indicating data $PD_4$, $PD_5$ in an address "2" shown in FIG. 5 are written in the registers DT, NDT, and when the content of the register CLK is "5", the tone generating mode indicating data $PD_5$ in the address "2" and the tone generating mode indicating data $PD_6$ in an address "3" are written in the registers DT, NDT. Incidentally, if the value of CLK+1 is "48" in the step SPe5, the lower four bits in an address "0" is written.

Next, in a step Spe6, if the content of the register DT is $(F)_H$, i.e., if the tone generating mode indicating data PD to be processed at the timing is "do nothing" is checked. If the check result is "YES", the program goes to a step SPe11 to check if the content of the register NDT is $(F)_H$, i.e., if a tone generating mode indicating data PD to be processed next is "do nothing". If the check result is "YES", the program returns, and if the check result is "NO", if the content of the register DL1 is "0" is checked in a step SPe12. Since the register DL1 is cleared by the initializing process in the step SP1 shown in FIG. 6, the check result in the step Spe12 is "YES" and the program goes to a step SPe15 to check if the content of the register DL2 is "0". Since the register DL2 is also reset in the step SP1, the check result is "YES" and the program returns. When the content of the register DT is $(F)_H$ as described above, the program returns to the step SPd5 of the subroutine "CLK.IRQ" through the steps SPe6, SPE11 and further through the steps SPe12 and SPe15. The content of the register CLK is incremented by 1 in the step SPd5. The reason why the calculation shown in the drawing is effected in the step SPd5 to circulate the content of the register CLK from "0" to "47".

If the check result is "NO" in the step SPe6 shown in FIG. 13, the program goes to a step Spe7 to check if the content of the register DT is $(0)_H$. If the check result is "YES", the key-off of all the tone generation channels $ch_0$–$ch_2$ of the tone generator 12 is effected because the key-off is indicated at the timing and the registers $KEY_{0-2}$ are cleared (steps Spe8, Spe9). If the check result in the step SPe7 is "NO", the flag MODE is made to "0" in the step SPe10, then the program goes to the processes in the subroutine "PAT.KEY".

The processes in the subroutine "PAT.KEY" are as described above, wherein if a key-on mode is normal and the flag MODE is "0", tone is generated by the process SPc1–SPc8. Afther the tone generation processes are completed, the program returns to the step SPE11. If the key-on mode is normal, the program returns to the step SPd5 in the FIG. 12 through the step SPE11 or the steps SPe12 and SPe15 to increment the register CLK.

The above processes are effected each time the tempo clock TP is generated. The aforesaid is the processes of the key-on mode "normal".

B: Delay key-on

Next, the case of delay key-on will be described.

The delay key-on is the same as the above normal case except that the contents to be processed in the subroutines "PAT KEY" and "PAT READ" are changed and the processes in a subroutine "TIMER-.IRQ" are added. First, the processes in the subroutine "PAT.KEY" will be described.

(1) Subroutine "PAT.KEY" (Delay key-on)

First, the step SPc1 through the step SPc6 are the same as those of the normal case, but the program goes to a step SPc10 by the check result in the step SPc6 to check if the register MODE is "1". If the check result is "YES", the program goes to a step SPc9 to replace the key chords in the channels $ch_0$–$ch_2$ with the key codes in the registers $KEY_{0-2}$ and to generate tones of all the three key codes. More specifically, no delay-on process is effected and the three tones are generated simultaneously. This is because that the register MOD becomes "1" when tones are continuously generated by pattern data before a change of a chord occurs in the case that a key event has occurred for changing the chord and then the execution of a delay-on according to a new key code becomes musically unnatural.

On the other hand, if the check result is "NO" in the step SPc10, the delay time data (FIG. 5) written in the register DLYTM in the step SPb2 or the step SPe2 is written in the register DL1 and the delay time data is doubled to be written in the register DL2. Then, the program goes to a step SPc12 to supply the key code in the register $KEY_0$ to the channel $ch_0$ to turn on the key. More specifically, the key code in the register $KEY_0$ (the lowest tone of tones composing a chord as shown in FIG. 4) is generated immediately without effecting delay key-on. When the process in the step SPc12 is completed, the program returns to the main routine "MAIN" at once or returns to the main routine through the step SPE11→(the steps SPc12, SPc15) in FIG. 13→the step SPd5 in FIG. 12. The former is the case wherein "PAT.KEY" is called in the subroutine "PAT.CHG" and the latter is the case wherein "PAT.-KEY" is called in the subroutine "PAT.READ". When a pulse signal IP is outputted from the timer 8 while the program is circulating in the main routine "MAIN", the program goes to the processes in a subroutine "TIMER.IRQ". In the case, since the cycle of the pulse signal IP is set sufficiently shorter than that of the tempo clock, the processes in the subroutine "TIMER-.IRQ" are usually effected before a subsequent tempo clock TP is supplied.

(2) Subroutine "TIMER.IRQ"

First, if the content of the flag RUN is "1" is checked in a step SPf1. If the check result is "NO", a program returns to the main routine "MAIN", and if the check result is "YES", the program goes to a step SPf2. If the content of the register DL1 is "0" is checked in the step SPf2. If the check result is "0", the program goes to a step SPf6, and if the check result is not "0", the content of the register DL1 is decremented by 1 (step SPf3). Then, the content of the register DL2 after the decrement is "0" is checked (SPf4). If the check result is "0", the key code in the register $KEY_1$ is supplied to the channel $ch_1$ for effecting key-on. If the check result in the step SPf4 is "NO", the program goes to a step SPf6.

Figure 15:
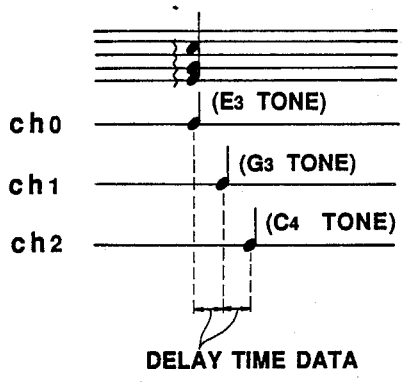
FIG. 15 is a timing chart explanatory of a delay key-on process.

Next, the processes in steps SPf6–SPf9 are effected to the register DL2 in the same manner as those in the above SPf2–SPf5. When the process in the step SPf9 is completed, the program returns to the main routine "MAIN" and returns again to the subroutine "TIMER-.IRQ" when a pulse signal IP is supplied again. As described above, when the processes in the subroutine "TIMER.IRQ" are effected each time the pulse signal IP is supplied, the contents of the registers DL1 and DL2 in which the delay time data was written at first are descremented successively as the processes in the steps SPf3 and SPf7 are effected, and when the result of the decrement becomes "0", the key codes in the registers $KEY_1$, $KEY_2$ are supplied to the channel $ch_1$ or $ch_2$ for effecting key-on. More specifically, the tone generated by the channel $ch_1$ appears later than that generated by the channel $ch_0$ by a delay time. In addition, since the content of the register DL2 is twice as large as that of the register DL1 (refer to step SPc11), the tone generated by the channel ch2 appers later than that generated by the channel $ch_1$ by the delay time. This is shown in FIG. 15.

(3) Steps SPe13–SPe17 of Subroutine "PAT.READ"

Figure 16:
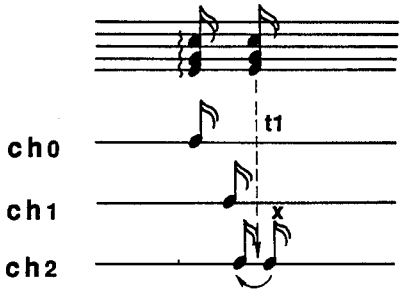
FIG. 16 is a timing chart showing a prohibition process in a delay key on process.

Incidentally, if the delay key-on process is effected when the tempo of music is fast, a timing to generate a tone of a key code subject to the delay process may appear later than a subesquent note to be generated to a tone next. For example, as shown in FIG. 16, when a delay key-on process is effected to a first sixteenth-note, a tone generation timing of the channel $ch_2$ may appear later than the tone generation timing $t_1$ of a subsequent sixteen-note. Since this is musically unnatural, the delay process is interrupted in the case and the tone generation timing of the channel ch2 is shifted in front of the timing $t_1$.

The processes in the steps SPe13–SPe17 are effected for the purpose. The processes will be described below.

Assume now that a subsequent tempo clock TP is generated before a delay key-on process is not completed. As a result, the program goes to the processes in the subroutine "PAT.READ" through the subroutine "CLK.IRQ". Then, a check in the step Spe11 is effected through the step SPe1 to the step SPe6. In this case, when tone generation is effected at the timing of a subsequent tempo clock TP, the program goes to the step SPe12 to check if the content of the register DL1 is "0" because the check result in the step SPe11 is "NO". If the check result is "NO", it is the case that the delay key-on process is not yet effected for the tone generation channel $ch_1$, and then the register DL1 is cleared in the step SPe13 and further the key code in the register $KEY_1$ is supplied to the channel $ch_1$ for forcibly effecting the key-on of it. (step SPe14). If the check result in the step SPe12 is "YES", if the content of the register DL2 is "0" is checked in the step SPe15. If the check result is "YES", the program returns to the main routine "MAIN" through the step SPd5 because the delay on-key processes in both the channels $ch_1$, $ch_2$ are completed. In addition, if the check result is "NO" in the step SPe15, the register DL2 is cleared and the key code in the register $KEY_2$ is supplied to the channel $ch_2$ for forcibly effecting the key-on of it. After the process is completed, the program returns to the main routine "MAIN" through the step SPd5.

The aforesaid is the processes for the delay key-on.

C: Tie key-on

Next, the processes of tie key-on will be described.

The processes are the same as those in the processes for the above normal case except the processes in the subroutine "PAT.KEY".

The processes in the step SPc1 through the step SPc6 are the same as those of the normal case, but the check result in the step SPc6 is "1", then the program goes to a step SPc13. In the step SPc13, a register i is cleared and further in a step SPc14 a register j is cleared. Then, the program goes to a step SPc15 to compare the content of the register OKEYi with that of the register KEYi. This process is effected to check if the previous key code data written in the register OKEYi in the step SPc3 coincides with the present key code data written in the register KEYi in step SPc5. Further, if the content of the register i is different from that of the register j is also checked in the step SPc15. An initial check in the step SPc15 is to compare the content of the register $OKEY_0$ with that of the register $KEY_0$, but since i=j, the check result is "NO", and the program goes to a step SPc17. In the step SPc17, the content of the register j is incremented by 1 and the program goes to the process in a step SPc18. The step SPc18 is a process to check if the value of the register j is less than "3". If the increment process is effected twice or less in the step SPc17, the check result is "YES", and then the program goes to the step SPc15 for effecting the comparison process. A second comparison process in the step SPc15 checks if $OKEY_0=KEY_1$. If the check result is "YES", the content of the register KEYi is replaced with that of the register KEYj (step SPc16). More specifically, in the above case, the content of the register $KEY_0$ is replaced with that of the register $KEY_1$. Thereafter, the content of the register j is incremented in the same manner and the process in the step SPc15 is effected again. When the process in the step SPc 17 is effected after the process is completed, the check result in the step SPc18 becomes "NO" so that the content of the register i is incremented in a step SPc19. Next, the program goes to a step SPc20 to check if the content of the register i is less than 3. Since the check result is "YES" if the process in the step SPc19 is effected twice or less, the program returns again to the process in the step SPc14. More specifically, the value of the register i is generated to "1" and the above processes are repeated. Thereafter, the above processes are repeated with the register i having the value made to "2". When the program goes to the step SPc20 again, the check result becomes "NO" and then the program passes through the loop composed of the step SPc14 to the step SPc20.

If the register OKEYi=KEYj by the processes of the loop, the content of the register KEYi is replaced with that of the register KEYj. As a result, if the key chord for generating tone next in the register KEYi ($i_{0\sim2}$) is the same as the key code of the tone generation channel $ch_i$ which generates tone at present, it is replaced with that of the register KEYi of which number is identical with the tone generating channel $ch_i$. However, if the register KEYi of which number is identical with the tone generation channel $ch_i$ has the same key code written therein from the beginning, the replacement is not necessary and then the process is not effected.

For example, as shown in FIG. 17, assume that a chord (chord G) composed of a tone $G_3$, a tone $B_3$ and a tone $D_4$ is played at present and key code "67", "71", and "74" are written in the registers $OKEY_0$. $OKEY_1$ and $OKEY_2$, respectively and that tone to be generated next is a tone $E_3$, a tone $G_3$ and a tone $D_4$ (codes $C_{9th}$) and key chords "64", "67" and "74" are written in the registers $KEY_0$, $KEY_1$ and $KEY_2$, respectively. In this case, $KEY_2=OKEY_2$, $KEY_1=OKEY_0$, but $KEY_0$ has nothing to coincide with it. Therefore, the register $KEY_2$ remains as it is, but the content of the register $KEY_1$ is replaced with that of the register $KEY_0$. Their corresponding relation is shown in a table 1.

TABLE 1

| | |
|---|---|
| $OKAY_2$ "74" | $KEY_2$ "74" |
| $OKAY_1$ "71" | $KEY_1$ "64" |
| $OKAY_0$ "67" | $KEY_0$ "67" |

Next, when the register i is cleared in a step SPc21, if the content of the register OKEYi having the same number as the register KEYi is equal to that of the register KEYi is checked in a step SPc22. If the check result is "NO", the program goes to a step SPc23 to check if the flag MODE is "1". If the check result is "NO", it is the case wherein no tone is generated at present, and then the key code of the register $KEY_1$ is supplied to the tone generation channel $ch_1$ for effecting a key-on process (step SPc24). If the check result is "YES", it is the case wherein tone is generated at present, and then the key code in the tone generation channel chi is replaced with the key code of the register KEYi to effect a tone generation process (step SPc25). When these processes are completed, the register i is incremented in a step SPc26 and the program goes to the step SPc22 through a step SPc27 to repeat the above operation.

If the check result in the step SPc22 is "YES", no new tone generation is effected (step SPc24, 25) and the program goes to the step SPc22 through the steps SPc26, SPc27 to repeat the above processes. If the new tone generation process is not effected as above, the tone generation channel chi is continuously generating the previous tone as it is.

When the processes in the steps SPc22–SPc26 are effected three times, the check result in the step SPc27 becomes "NO", and then the program returns.

When the above processes are effected according to the example shown in the table 1, OKEYi=KEYi if i=0 and i=2. Thus, the tone generation channels $ch_0$ and $ch_2$ do not effect new tone generation processes and generate the previous tones $D_4$ and $G_3$ continuously. In addition, the tone generation channel $ch_1$ generates a new tone $E_3$. As a result, as shown in FIG. 17, the tones $D_4$ and $G_3$ are generated as notes connected by ties.

The aforesaid is the description of the tie key-on processes.

D: Example of total operation

FIG. 18 shows an example of pattern data. FIG. 19 shows an example of a performance in which a table #0 is selected in the pattern data and a chord type is C major. As shown in the drawing, since a tone generating mode indicating data $PD_0$ at the front timing (CLK="0") of a first section is $(9)_H$, a key-on mode is delay key-on as shown in FIG. 5 and a musical interval mode number TBLNO is "0". Therefore, as shown in FIG. 19, a performance is effected based on the delay key-on mode with a tone $E_3$, a tone $G_3$ and a tone $C_4$. Since the tone generating mode indicating data PD is $(F)_H$ at the timing at which the register CLK is "1"–"10", nothing is done. Since the tone generating mode indicating data PD is $(0)_H$ at the timing at which the register CLK is "11", the tones are damped. As a result, as shown in FIG. 19, the tones $E_3$, $G_3$ and $C_4$ are generated in the length of a quarter-note. Since the tone generating mode indicating data PD is $(1)_H$ at the timing at which the register is "12", a musical interval number TBLNO "0" is selected in normal key-on. Therefore, the tones $E_3$, $G_3$ and $C_4$ are generated at the timing. Since the tone generating mode indicating data is $(0)_H$ at the timing at which the register CLK is "17", the above tones are damped at the timing. As a result, the above tones are generated in the length of an eight-note. Next, since the tone generating mode indicating data PD is $(A)_H$ at the timing at which the register CLK is "18", a musical interval number TBLNO is "1" in delay key-on. As a result, tones corresponding to a chord $C_{9th}$ (refer to FIG. 4) are generated, that is, a tone $E_3$, a tone $G_3$ and a tone $D_4$ are generated. Since the tone generating mode indicating data PD at the timing at which the register CLK is "24" is $(5)_H$, the key-on mode is a tie key-on and a musical interval number TBLNO is "0" as shown in FIG. 5. As a result, a tone $E_3$, a tone $G_3$ and a tone $C_4$ are generated and the tones $E_3$ and $G_3$ are generated as tones connected by a tie symbol. Further, since the tone generating mode indicating data is $(0)_H$ at the final timing (CLK="23") of a second section, the tone $C_4$ at a third section is generated without being damped (tone generation by the replacement of a key code), i.e., a tone connected by a slur symbol is generated. Next, tone damping is indicated at the time when the register CLK is "29" and the tone generating mode indicating data PD remains $(F)_H$ thereafter until the front timing of a fourth section. With this arrangement, an eight-rest is expressed as shown in FIG. 19. Since the tone generating mode indicating data PD is $(3)_H$ and $(1)_H$ at the front timing of a fourth section and at the ½ timing of the fourth beat, a tone $\flat E_3$, a tone $\flat G_3$ a tone $\flat C_4$ (=tone $B_3$) and a tone $E_3$, a tone $G_3$ and a tone $C_4$ are generated in the length of an eight-note, respectively.

(3: Effects of the Embodiment)

As described above, in the embodiment, since a timing at which tone is generated and a change in a musical interval are indicated by the tone generating mode indicating data, a performance full of variety can be effected in spite of a less amount of pattern data stored. More specifically, since the tone generating mode indicating data is composed of 4 bits, accompaniment data of a particular chord type to a particular rhythm can be formed in a capacity of 24 bytes for a score. As a result, even if rhythm patter data is provided for each chord type and each kind of rhythm, a memory capacity can be reduced.

(4: Modification of the Embodiment)

The above embodiment can be modified as follows.

(1) Although the above embodiment is described chiefly about a performance by an accompanying keyboard, it can be arranged to enable a performance of melody together with the accompaniment by providing a melody keyboard.

(2) Although a performance of a single chord is described as a mode of an automatic accompaniment, other parts such as base tone and an automatic performance of arpeggio can be combined. In addition, although root tone itself is not generated in the above embodiment, it can be also arranged to generate the root tone.

(3) Although a delay time is measured by the specialized timer 8 in delay key-on, the delay time may be measured using the tempo clock TP.

(4) Although the resolution and beat of the tempo are "48" and a 4/4 beat in the embodiment, they are not limited to them and any other arbitrary resolution and beat may be set and they may be also arranged in combination.

(5) In the embodiment, a plurality of tables are provided, the table may be only one. In this case, the table select data TBSEL is not necessary.

(6) The change in a musical interval in the embodiment is effected by the tone generating mode indicating data PD through the selection of the interval mode number TBlNO in the table, it may be effected by calculation instead of the table.

For example, a half tone lowering change (interval mode number 2 in FIG. 5) and the like may be effected by decrementing the value of a key code by 1 routinely.

(Effects of the Invention)

According to the present invention, as described above, there are provided a clock generating means for generating a clock signal, a memory means for storing rhythm pattern data designating the presence or absence of tone generation and a musical interval mode of a chord for generating tone at each timing of a performance based on the clock signal, a chord designating means for designating a chord to be played, a tone data creating means for reading the pattern data successively based on the clock signal and creating tone data of each tone composing the chord for generating tone based on the interval mode designated by the read pattern data and the chord designated by the chord designating means, and a musical tone generating means for generating the chord based on the tone data supplied from the tone data creating means, and then chords full of variety can be played with a less amount stored data.

Further, when a tone of which pitch is the same as that of tones composing a chord to be generated newly is detected from the tones composing the chord being generated at present at a change of the chord in the case that the pattern data designates the generation of a tie expression, the tone is generated continuously, and then the tie expression can be given to any arbitrary notes in an automatic accompaniment to provide a unique performance effect.

Furthermore, since shift times used to generate tones composing a chord in a shifting manner are stored in the time storing means in correspondence to the pattern data and the shifted tone generation control means is operated based on the data in the time storing means, an accompanying performance with a background performance effect full of variety can be automatically effected.

In addition, when the automatic accompaniment apparatus is provided with a shifted tone release means, delayed tones composing a chord is prevented from being generated after the tone generation timing of a subsequent chord due to the shifted tone generation, and then a musically unnatural accompaniment can be prevented.

What is claimed is:

1. An automatic accompaniment apparatus, comprising:

(a) clock generating means for generating a clock signal;

(b) memory means for storing rhythm pattern data designating a presence or absence of tone generation and a musical interval of a chord to be generated at each performance timing based on said clock signal;

(c) chord designating means for designating a chord to be performed;

(d) tone data generating means, including a tone data table having data for plural musical interval modes for each of plural chord types, for reading out said rhythm pattern data based on said clock signal and generating tone data representative of tones which constitute the chord to be generated based on a musical interval mode designated by said rhythm pattern data and the chord designated by said chord designating means; and (e) musical tone generating means for generating the chord based on said tone data.

2. An automatic accompaniment apparatus according to claim 1 wherein plural kinds of said rhythm pattern data are provided respectively for plural rhythm kinds, said tone data generating means generating said tone data in accordance with the musical interval designated by said rhythm pattern data corresponding to the rhythm designated by rhythm selecting means.

3. An automatic accompaniment apparatus, comprising:

(a) chord designating means for designating a chord to be performed;

(b) memory means for storing pattern data which control generation of a chord to be generated and a tie expression at each performance timing based on a clock signal;

(c) musical tone generating means for generating constituent tones constituting the chord to be generated based on said pattern data and a chord designated by said chord designating means, wherein said pattern data are sequentially read from said memory means based on said clock signal; and (d) tone generation control means for detecting tone pitches of the constituent tones of a chord to be newly generated within the constituent tones of a chord which are presently generated when read pattern data designate the tie expression, whereby said tone generation control means controls tone generation such that constituent tones having detected tone pitches are continuously generated.

4. An automatic accompaniment apparatus, comprising:

(a) chord designating means for designating a chord to be performed;

(b) pattern storing means for storing pattern data designating generation of a chord based on a clock signal, said pattern data also designating whether or not each of the constituent tones constituting the chord to be generated in a shifting manner, wherein said shifting manner designates that chord-constituting tones are to be generated successively and a timing at which a later constituting tone of a chord is to be generated depends on a timing of an earlier generated constituting tone of the same chord;

(c) time storing means for storing a shifting time which is used when each constituent tone of a chord must be generated in the shifting manner, said time storing means being provided in correspondence with said pattern data;

(d) musical tone generating means for generating each constituent tone of a chord based on said pattern data and a chord designated by said chord designating means, wherein said pattern data are sequentially read from said pattern storing means based on said clock signal; and (e) shifting means for shifting generation timings of the constituent tones of a chord relative to one another in accordance with said shifting time in said musical tone generating means when said pattern data designate that the constituent tones of the chord must be generated in the shifting manner.

5. An automatic accompaniment apparatus, comprising:

(a) chord designating means for designating a chord to be performed;

(b) pattern storing means for storing pattern data designating generation of a chord based on a clock signal, said pattern data also designating whether or not each of the constituent tones constituting the chord is to be generated in a shifting manner, wherein said shifting manner designates that chord-constituting tones are to be generated successively and a timing at which a later constituting tone of a chord is to be generated depends on a timing of an earlier generated constituting tone of the same chord;

(c) time storing means for storing a shifting time which is used when each constituent tone of a chord must be generated in the shifting manner, said time storing means being provided in correspondence with said pattern data;

(d) musical tone generating means for generating each constituent tone of a chord based on said pattern data and a chord designated by said chord designating means, wherein said pattern data are sequentially read from said pattern storing means based on said clock signal;

(e) shifting means for shifting generation timings of the constituent tones of a chord in accordance with said shifting time in said musical tone generating means at a first performance timing when said pattern data designate that the constituent tones of a chord must be generated in the shifting manner; and (f) releasing means for releasing shifting control of said shifting means before a second performance timing when said pattern data designate generation of a chord after said first performance timing, whereby the constituent tones which have not been generated yet are forced to be generated.

* * * * *